US005444334A

United States Patent [19]

Speaker et al.

[11] Patent Number: 5,444,334

[45] Date of Patent: Aug. 22, 1995

[54] SYSTEM FOR STARTING A HIGH INTENSITY DISCHARGE LAMP

[75] Inventors: Lawrence W. Speaker; George E. Kiefer, both of Hendersonville, N.C.

[73] Assignee: General Electric Company, Schenectady, N.Y.

[21] Appl. No.: 306,342

[22] Filed: Sep. 15, 1994

[51] Int. Cl.[6] ..... H05B 37/02

[52] U.S. Cl. ..... 315/209 CD; 315/209 M; 315/227 R; 315/242; 315/220; 315/289

[58] Field of Search ..... 315/289, 209 CD, 209 T, 315/209 M, 227, 242, 220, DIG. 5, DIG. 7, 241 S

[56] References Cited

U.S. PATENT DOCUMENTS 4,169,445 10/1979 Gerry ..... 315/209 CD
4,369,757 1/1983 Anzai ..... 315/209 CD
5,084,800 1/1992 Hijikata ..... 315/209 M

*Primary Examiner*—Robert J. Pascal
*Assistant Examiner*—Reginald A. Ratliff
*Attorney, Agent, or Firm*—George E. Hawranko; Stanley C. Corwin

[57] ABSTRACT

A ballast circuit arrangement with hot restrike capabilities includes an input transformer having a primary winding receptive of line power and a secondary winding over which an output voltage is made available. A first capacitor coupled across the secondary winding of the input transformer develops a voltage charge thereon. A resistor and a second capacitor are series connected to one another and are parallel coupled across the first capacitor. A starting aid device is coupled to the secondary winding of the input transformer and produces an output voltage of a predetermined magnitude. The output voltage of the starting aid is coupled to a spark gap device having first, second and third electrodes associated therewith. A first spark gap formed between the second and third electrode is first fired by the output voltage of the starting aid which in turn triggers the firing of a second spark gap formed between the first and second electrodes. A pulse transformer having a primary winding coupled between the spark gap device and the series connection between the resistor and second capacitor provides a discharge path for the second capacitor. Upon the firing of the second spark gap, the primary winding of the pulse transformer produces a starting pulse through a secondary winding of the pulse transformer. The starting pulse is effective for starting the discharge lamp under predetermined conditions including a condition where it is desired to restart the discharge lamp immediately following the discharge lamp being extinguished.

11 Claims, 1 Drawing Sheet

SYSTEM FOR STARTING A HIGH INTENSITY DISCHARGE LAMP

CROSS-REFERENCE TO RELATED APPLICATIONS

This application is related to the following, applications that are commonly owned by the present assignee: "Boosting of Lamp Drive Voltage During Hot Restrike," U.S. Ser. No. 08/306,800 (Applicant Docket No. LD 10736), filed concurrently herewith; and, "Regulation of Hot Restrike Pulse Intensity and Repetition," U.S. Ser. No. 08/306,869 (Applicant Docket No. LD 10738), filed concurrently herewith. The disclosures of the foregoing applications are herein incorporated by reference.

FIELD OF THE INVENTION

This invention relates to an arrangement for starting a high intensity discharge (HID) lamp. More particularly, this invention relates to such a system as can provide for a hot starting arrangement for such an HID lamp as may be used in lighting fixtures where it is necessary to start or restart a lamp in a relatively short period of time.

BACKGROUND OF THE INVENTION

High intensity discharge (HID) lamps are utilized in various lighting applications where large areas have to be illuminated such as for instance in factories, parking lots and sporting fields/arenas. In some such applications, it is desirable to have the light source reach a reasonable level of brightness as quickly as possible particularly if there has been a momentary power outage at a sporting event and the lamps have to be restruck so as to allow resumption of the sporting event. Typically, for a metal halide HID lamp, the time to restart the lamp after it has been momentarily extinguished is on the order of approximately 10 to 15 minutes.

To allow for a rapid restriking of the metal halide HID lamp, a circuit arrangement is typically utilized which can provide a starting or ignition signal having a relatively high voltage at a relatively high current level. Such an starting or ignition signal is needed to initiate the desired ionization condition for the constituents which make up the fill contained within the arc tube of such a metal halide HID lamp. An example of such a metal halide HID lamp and associated starting circuitry can be found in U.S. Pat. No. 4,723,097 which is assigned to the same assignee as the present invention and is herein incorporated by reference. To provide for the lamp ignition, the associated circuitry can employ a spark gap device having relatively high voltage and current carrying capabilities. A common spark plug device is an example of such a spark gap device and has associated therewith, electrodes with ends that are separated by a predetermined length. The problem with such a spark plug device is that over time, the ends of the electrodes erode thereby causing the separation gap therebetween to become larger. As a consequence of the larger separation gap, the voltage potential that must be applied across the electrodes to render the spark plug conductive must continue to increase until the potential becomes such a significant value that it cannot be achieved. Of course, once the voltage potential becomes unattainable, the spark plug device and the hot restrike circuit in which it is disposed, become inoperative.

As a solution to the problem of the eroding ends of a spark plug device, U.S. Pat. No. 4,975,624, assigned to the same assignee as the present invention and herein incorporated by reference, proposes the use of a spark gap device which has two electrodes that are disposed in a parallel side-by-side relationship at a predetermined distance from one another. By this approach, the spark which occurs across the electrodes when a high voltage potential is applied, is distributed along the parallel arranged electrodes rather than being confined to the specific end regions where electrode erosion can occur. As such, the invention of U.S. Pat. No. 4,975,624 has proven advantageous in achieving the 20 to 40 kilovolt high voltage pulses needed to hot start an HID lamp. It has been found however that the use of this type of spark gap device typically operates most efficiently with higher wattage metal halide lamps such as those on the order of about 1500 Watts. When it is necessary to hot restart an HID lamp of a lesser wattage, for instance one requiring a standard ballast having a 600 V input voltage level, it has been found that such spark gap devices do not switch at the same voltage every time. Additionally, because the hot restrike circuit arrangement of the previously discussed U.S. Pat. No. 4,975,624 operates at a high input voltage range of between 2000 and 4000 volts, it is necessary to utilize a large input transformer which adds weight, size and cost to the overall circuit as compared to the input transformer that can be utilized with a low voltage input of around 600 volts.

Therefore, it would be advantageous if a hot starting circuit arrangement could be provided for a lower wattage metal halide lamp where a spark gap device having long life and consistent performance characteristics, would be included.

SUMMARY OF THE INVENTION

It is therefore an object of the present invention to provide a hot restarting circuit arrangement for a metal halide HID lamp which utilizes a spark gap configuration that allows for the use of a ballast circuit operable at approximately a 600 V input voltage range.

In accordance with the principles of the present invention, there is provided a circuit arrangement for operating an HID lamp and for providing hot restrike capabilities for the lamp. The circuit arrangement includes a ballast transformer member receptive of line power over a primary winding and having a secondary winding which has an energy storage device coupled in parallel thereto. A series connected resistor and capacitor arrangement are connected in parallel across the energy storage device. A starting aid device is coupled across the secondary winding of the ballast transformer and is operable so as to output a voltage of a predetermined magnitude upon each occurrence of the peak output voltage of the ballast transformer. A spark gap device having a first, second and third electrode is coupled to the starting aid device through the first electrode member of the spark gap device. A first spark gap associated with the spark gap device is fired upon the output of the voltage pulse from the starting aid. The firing of the first spark gap in turn causes the firing of a second spark gap which is formed between the second and third electrodes. A pulse transformer having a primary winding connected to the capacitor of the series resistor, capacitor arrangement, has its secondary winding connected to the discharge lamp so that upon the firing of the second spark gap, the capacitor is discharged through the primary winding of the pulse transformer thereby producing a high voltage starting pulse for starting the discharge lamp.

In an alternate embodiment, the starting aid can be selected to provide multiple pulses thereby allowing that the capacitor can be charged and discharged multiple times. This multiple charging and discharging of the capacitor of the series resistor, capacitor arrangement supplies a high average current to cause the discharge lamp to drop in voltage to where the ballast transformer can sustain lamp operation and thus achieve a hot restrike operation for such lamp.

BRIEF DESCRIPTION OF THE DRAWING

In the following detailed description, reference will be made to the attached drawing in which.

DETAILED DESCRIPTION OF THE INVENTION

Figure 1:
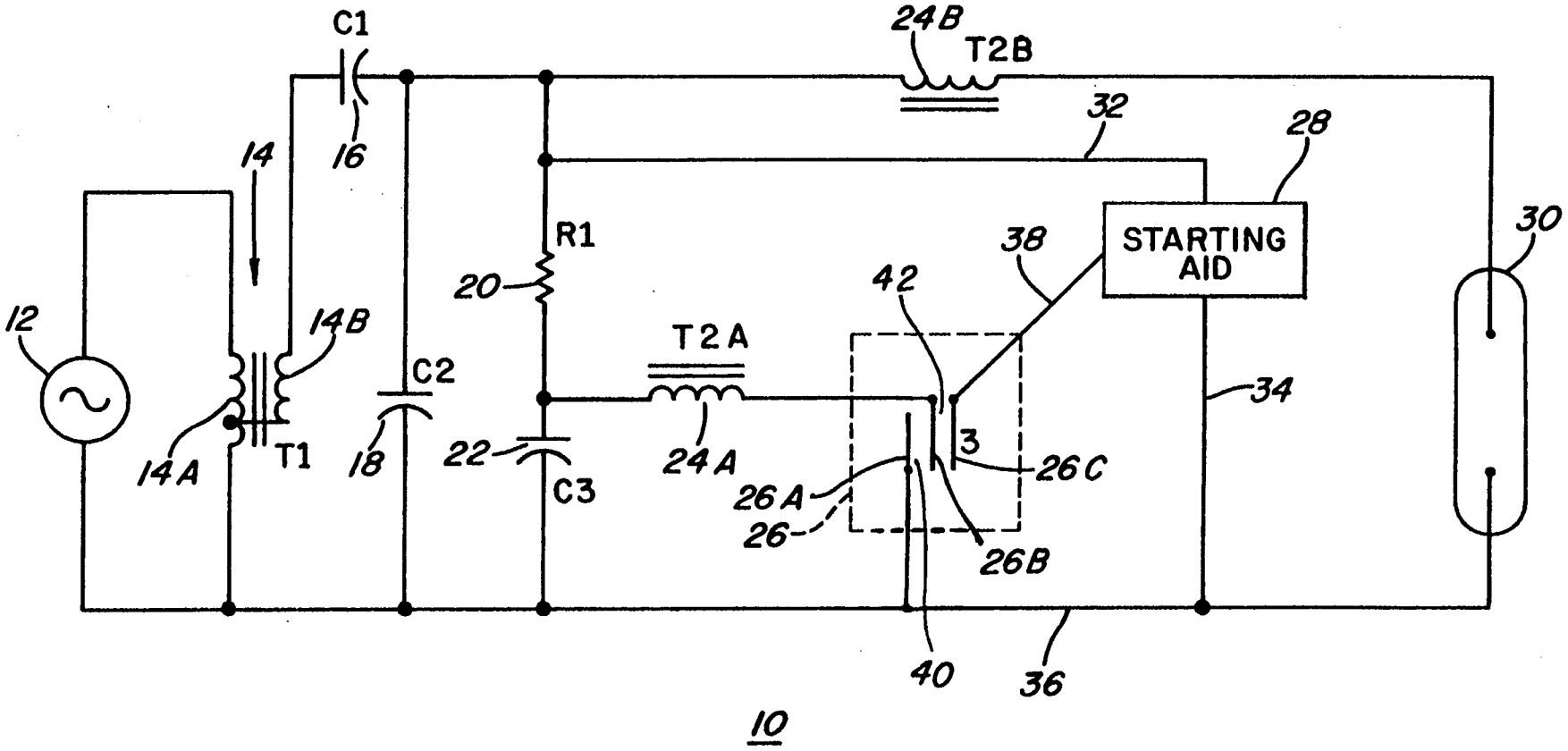
FIG. 1 is a circuit diagram of a ballast circuit arrangement for a discharge lamp having the hot restrike feature configured in accordance with the present invention.

As seen in FIG. 1, the ballast circuit arrangement 10 for a discharge lamp 30, which provides for hot restrike capabilities for the discharge lamp 30, includes a ballast or input transformer 14 having a primary winding 14*a* and a secondary winding 14*b*. The primary winding of ballast transformer 14 is connected to the power source 12 which can be for instance, 240 volt, 60 Hertz line power. Of course, it should be understood that the primary winding can have different tap connections to allow for coupling to different input power systems such as 120 volts, 208 volts, 270 volts etc. at either 50 or 60 Hertz, such a modification being contemplated as within the scope of the present invention. Connected to one leg of the secondary winding 14*b* is a ballast capacitor C1, identified as reference number 16; such ballast capacitor being utilized in a conventional manner for ballasting and power factor purposes. A high frequency capacitor C2, identified as reference 18, is placed across the secondary winding 14B of ballast transformer 14. The capacitive value of capacitor C2 is selected so as to allow the output voltage of ballast transformer 14 to charge up to a level of over 600 volts peak value. Capacitor C1 is further effective for producing the desired phase angle between the current and voltage supplied by the source 12, and, in combination with the ballast transformer 14, limits current to the lamp 30.

Coupled across high frequency capacitor C2 is a series connected resistor R1 and capacitor C3 configuration 20, 22. Capacitor C3 is charged through resistor R1 to almost the peak value of the output voltage of ballast transformer 14, namely, to a value of almost 600 volts. Resistor R1 has a low resistance value, preferably on the order of about 50 Ohms, so as to allow for the charging of capacitor C3 to the desired voltage level. The capacitive values of C2 and C3 are preferably on the order of 1 microfarad.

A starting aid device 28, of a type generally available in the marketplace, is connected across the resistor R1/capacitor C3 series configuration 20, 22 and is receptive of the output voltage of the ballast transformer 14. The starting aid 28 can also be provided by use of the circuit disclosed in the above cross-referenced application U.S. Ser. No. 08/306,869 (Applicant Docket No. LD 10738). The starting aid 28 has one lead 32 connected to a common point between capacitor C2 and resistor R1 and a second lead 34 connected to a common bus 36. In one embodiment, the starting aid 28 is configured so as to operate in a manner to produce an kilovolt pulse upon the occurrence of each peak output voltage level of the ballast transformer 14. In another embodiment utilizing the starting aid configuration of the above cross-referenced application U.S. Ser. No. 08/306,869 (Applicant Docket No. LD 10738) the starting aid 28 is configured to supply multiple current pulses during each cycle of the ballast transformer 14 output. This multiple pulse arrangement would be effective to cause capacitor C3 to charge and discharge multiple times thus supplying a high average current to the discharge lamp 30 and thereby allowing the voltage across the arc discharge of the lamp 30 to drop to the point at which the ballast transformer 14 can sustain lamp operation.

The multiple pulse arrangement described above is of a further advantage in that a spark gap device, illustrated as reference number 26 in FIG. 1, can be utilized having lower input voltage requirements as compared to the spark gap device described in previously discussed U.S. Pat. No. 4,975,624. The lower input voltage requirements of spark gap device 26 is largely a function of the use of a three electrode configuration wherein a third electrode 26C is connected to the starting aid 28 over lead 38, the operation of such spark gap device 26 as will be explained hereinafter in further detail.

Spark gap device 26 consists of first, second and third electrodes 26A, 26B, and 26C which are all made of heavy tungsten rods and are placed in a parallel yet offset arrangement in a ceramic body (not shown). The third electrode 26C can be smaller in diameter than the first and second electrodes 26A and 26B since it does not have to carry the same current load as the first and second electrodes 26A and 26B. In terms of displacement, it can be seen that a first spark gap 40 is formed between the first and second electrodes 26A and 26B whereas a second spark gap 42 is formed between the second and third electrodes 26B and 26C. The first spark gap 40 can be approximately 0.007 inches and allow for a breakdown voltage of between 1.0 and 2.0 kilovolts therebetween. The second spark gap can be approximately 0.017 inches and allow for a breakdown voltage of between 3.0 and 5.0 kilovolts therebetween. The first electrode 26A is coupled to the common bus 36.

The second electrode member 26B is coupled to one end of a primary winding 24A associated with a high voltage transformer T2 identified as reference number 24. The other end of primary winding 24A is connected between the series connection of the resistor R1 and capacitor C3 arrangement 20, 22. In operation, the spark gap device 26 and high voltage transformer 24 cooperate in a manner so as to charge and discharge capacitor C3 multiple times by first firing the second spark gap 42 when the starting aid 28 fires. The firing of the second spark gap 42 by the starting aid 28 causes a sudden rise in voltage at the second electrode 26B which then results in the firing of the first spark gap 40 formed between the first and second electrodes 26A and 26B. Once the first spark gap 40 fires, capacitor C3 is discharged through the primary winding 24A of high voltage transformer T2. Discharging capacitor C3 through primary winding 24A produces a high voltage pulse through the secondary winding 24B of the high voltage transformer 24, such high voltage pulse being effective to hot restrike the discharge lamp 30.

In the embodiment using the starting aid arrangement of the above cross-referenced application U.S. Ser. No. 08/306,869 (Applicant Docket No. LD 10738) providing a starting aid 28 which produces multiple pulses to the second spark gap 42 formed between the second and third electrodes 26B and 26C, results in capacitor C3 being charged and discharged multiple times in comparison to previous ballast circuit arrangements having a hot restrike feature, an example of which is presented in previously discussed U.S. Pat. No. 4,975,624. With such multiple charging and discharging of capacitor C3, a high average current is supplied to the discharge lamp 30 thereby resulting in a drop of the voltage of the arc discharge and allowing the ballast transformer 14 to sustain steady state operation of the discharge lamp 30.

Although the present invention has been described in connection with a number of different embodiments, it is understood that other modifications to the invention can be made without departing from the scope of the invention as set forth in the appended claims.

We claim:

1. A ballast circuit arrangement for a discharge lamp, said ballast circuit arrangement having a hot restrike characteristic and comprising:

an input transformer receptive of an input signal, said input transformer having a first and a second winding associated therewith;

a first capacitor coupled to said second winding of said first transformer so as to develop a voltage charge therefrom;

a resistor and a second capacitor member connected in series and coupled across said first capacitor;

a starting aid device coupled across said second winding of said input transformer, said starting aid device being operated so as to output a voltage pulse of a predetermined magnitude as a function of the output of said input transformer;

a spark gap device having a first, second and third electrode member, said first electrode member being coupled to said starting aid device so that, upon the output of said voltage pulse, a first spark gap between said first electrode and said second electrode is fired, and whereby, upon firing of said first spark gap, a second spark gap between said second electrode and said third electrode is fired; and, a pulse transformer having a primary winding connected to said second capacitor, and a secondary winding coupled to said discharge lamp and wherein, upon the firing of said second spark gap, said second capacitor is discharged through said primary winding of said pulse transformer thereby producing a starting pulse through said secondary winding of said pulse transformer, said starting pulse being effective for starting said discharge lamp under predetermined conditions including a condition where it is desired to restart said discharge lamp immediately following said discharge lamp being extinguished.

2. A ballast circuit arrangement as set forth in claim 1 wherein said electrodes of said spark gap device are disposed in a substantially parallel relation to one another.

3. A ballast circuit arrangement as set forth in claim 2 wherein said second and third electrodes of said spark gap device are larger in diameter than said first electrode member.

4. A ballast circuit arrangement as set forth in claim 1 wherein said first spark gap breaks down at greater than 3 kilovolts but less than 5 kilovolts and said second spark gap breaks down at less than 2 kilovolts.

5. A ballast circuit arrangement as set forth in claim 1 wherein the spacing between said first and second electrodes which forms said first spark gap is larger than the spacing between said second and third electrodes which forms said second spark gap.

6. A ballast circuit arrangement as set forth in claim 1 wherein said starting aid is effective for outputting said voltage pulse as a function of the peak voltage level having been attained at said input transformer.

7. A ballast circuit arrangement as set forth in claim 1 wherein said starting aid is effective for outputting said voltage pulse multiple times during each cycle of the voltage output from said input transformer.

8. A high intensity discharge lighting system having hot restrike characteristics, said discharge lighting system comprising:

a high intensity discharge lamp;

a signal source having an output signal associated therewith;

means for conditioning said output signal of said signal source;

a first capacitor coupled to said conditioning means, said first capacitor being effective so as to develop a voltage charge thereon as a function of said conditioned output signal;

a resistor and a second capacitor connected in series with one another and parallel coupled across said first capacitor;

a starting aid device coupled to said conditioning means and being receptive of said conditioned output signal, said starting aid device being operated so as to output a voltage pulse of a predetermined magnitude as a function of said conditioned output signal;

a spark gap device having a first, second and third electrode member, said first electrode member being coupled to said starting aid device so that, upon the output of said voltage pulse, a first spark gap between said first electrode and said second electrode is fired, and whereby, upon firing of said first spark gap, a second spark gap between said second electrode and said third electrode is fired; and, a pulse transformer having a primary winding connected to said second capacitor, and a secondary winding coupled to said discharge lamp and wherein, upon the firing of said second spark gap, said second capacitor is discharged through said primary winding of said pulse transformer thereby producing a starting pulse through said secondary winding of said pulse transformer, said starting pulse being effective for starting said discharge lamp under predetermined conditions including a condition where it is desired to restart said discharge lamp immediately following said discharge lamp being extinguished.

9. A high intensity discharge lighting system as set forth in claim 8 wherein said electrodes of said spark gap device are disposed in a substantially parallel relation to one another.

10. A high intensity discharge lighting system as set forth in claim 9 wherein said second and third electrodes of said spark gap device are larger in diameter than said first electrode member.

11. A high intensity discharge lighting system as set forth in claim 8 wherein said conditioning means is an autotransformer operating at a voltage level of approximately 600 volts.

* * * * *